United States Patent [19]

Cerbo

[11] 3,969,224

[45] July 13, 1976

[54] METHOD AND APPARATUS FOR SEPARATING PARTICULATE MATERIAL

[75] Inventor: Thomas A. Cerbo, Carlstadt, N.J.

[73] Assignee: Potters Industries Inc., Carlstadt, N.J.

[22] Filed: May 22, 1974

[21] Appl. No.: 472,503

[52] U.S. Cl. ..... 209/12; 209/120; 209/214; 209/228

[51] Int. Cl.[2] ..... B07B 13/10

[58] Field of Search ..... 209/223 R, 214, 213, 209/148, 153, 120, 231, 129, 131, 145, 222, 39, 40, 12; 65/21, 8, 6

[56] References Cited

UNITED STATES PATENTS

| | | | |
|---|---|---|---|
| 80,704 | 8/1868 | Pearce | 209/120 |
| 97,037 | 11/1869 | Buchholz | 209/120 |
| 213,598 | 3/1879 | Wheeler | 209/223 R |
| 418,041 | 12/1889 | Mitchell | 209/223 R X |
| 455,984 | 7/1891 | Fiske | 209/145 X |
| 459,315 | 9/1891 | Stanfield | 209/120 |
| 653,792 | 7/1900 | Dasconaguerre | 209/120 |
| 1,358,375 | 11/1920 | Koch | 209/145 |
| 2,353,903 | 7/1944 | Johnson | 209/120 X |
| 2,724,504 | 11/1955 | Blind | 209/223 R |
| 3,520,407 | 7/1970 | Rumpf | 209/148 X |

FOREIGN PATENTS OR APPLICATIONS

| | | | |
|---|---|---|---|
| 1,022,533 | 1/1958 | Germany | 209/213 |
| 29,712 | 12/1970 | Japan | 209/22 |
| 43,895 | 1/1917 | Sweden | 209/120 |
| 1,085 | 1/1907 | United Kingdom | 209/222 |
| 14,105 | 6/1903 | United Kingdom | 209/120 |

*Primary Examiner*—Robert Halper
*Attorney, Agent, or Firm*—Lee C. Robinson, Jr.

[57] ABSTRACT

A method and apparatus for separating ferrous particles from crushed siliceous slag and for providing successive size gradations of the siliceous material. Particles of the raw slag are introduced into a rotary receptacle including an upstanding side wall which defines a series of apertures having radially disposed axes. As the receptacle rotates, the particles are centrifugally projected into a magnetic field to separate the ferrous particles from the silica and to withdraw the ferrous particles onto a nonmagnetic belt-type carrier. The siliceous particles are projected by the receptacle over different distances proportional to their masses and are collected in successive cylindrical receiving bins concentric with the receptacle's axis of rotation. In some embodiments the separating operation takes place within an enclosure which is maintained at subatmospheric pressure.

7 Claims, 4 Drawing Figures

FIG. 3
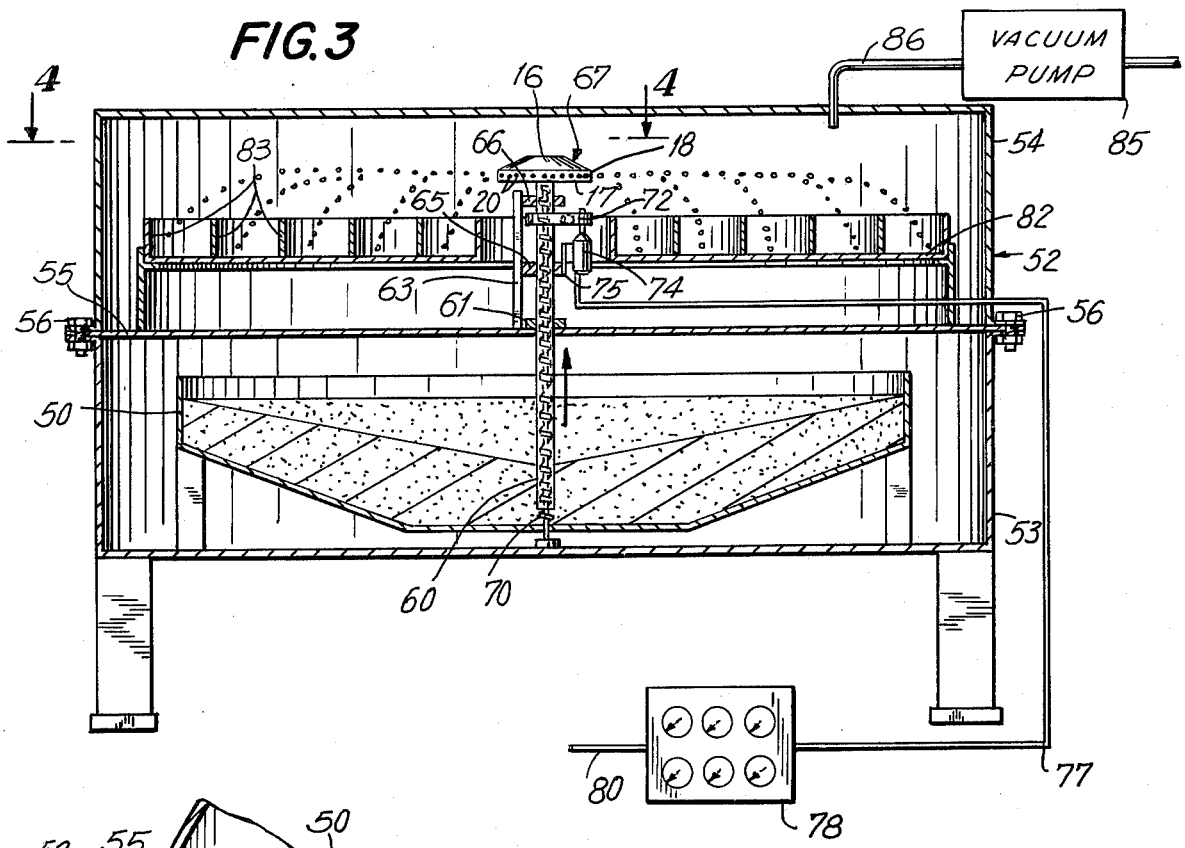
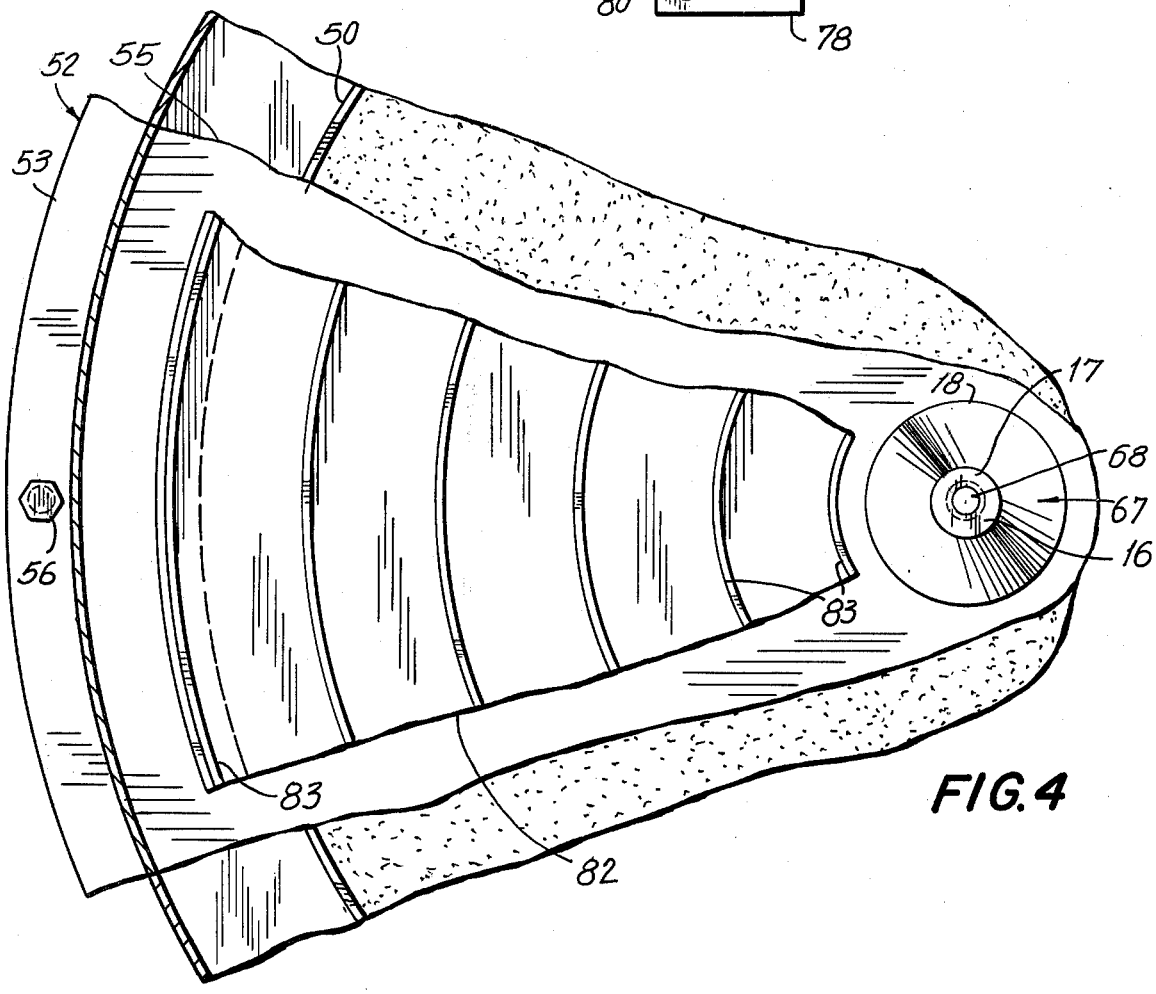
FIG. 4

METHOD AND APPARATUS FOR SEPARATING PARTICULATE MATERIAL

BACKGROUND OF THE INVENTION

This invention relates to the separation of particles and more particularly to a method and apparatus for separating particles having different physical characteristics.

The present invention, while of general application, is particularly well suited for use in the separation of particles having different masses and magnetic characteristics. Industrial wastes such as finely divided siliceous slag, for example, commonly contain usable quantities of ferrous material and a substantial amount of vitreous particles which exhibit considerable variations in size. Particularly if the vitreous particles are separated to provide successive size gradations, they may be readily converted into glass spheres in the manner described, for example, in U.S. Pat. No. 2,945,326 granted July 19, 1960 to Thomas K. Wood, U.S. Pat. Nos. 3,560,186 and 3,560,185 granted Feb. 2, 1971 to Arthur G. Nylander, and U.S. patent application Ser. No. 450,089 filed Mar. 11, 1974 by Thomas A. Cerbo, now U.S. Pat. No. 3,877,918.

Heretofore, difficulties have been encountered in the separation of particles having different masses and magnetic characteristics. As an illustration, the magnetic particles often were entrapped in the siliceous slag or other waste material and could not be readily separated through conventional magnetic or electrostatic techniques. In addition, particularly for the finer size particles, the material often tended to agglomerate and when store for stored period of time under high humidity conditions formed comparatively cohesive lumps which interfered with the separation process. Furthermore, and this has been of special moment in centrifugal separation systems or systems in which the particles were fluidized, unwanted drafts or other air currents frequently resulted in incomplete separation.

SUMMARY

One general object of this invention, therefore, is to provide a new and improved method and apparatus for separating particles of different physical characteristics.

More specifically, it is an object of this invention to provide such method and apparatus for separating particles having different masses and magnetic characteristics and for providing successive size gradations of at least one of the groups of separated particles.

Another object of the invention is to provide a method and apparatus of the character indicated which is effective to separate particles of ferrous material from siliceous slag or other vitreous substance.

Another object of the invention is to provide a separating method and apparatus in which the problems incident to any tendency of the raw material to agglomerate are substantially reduced.

Still another object of the invention is to provide a method for separating different size particles in which the separating operation is unaffected by unwanted drafts or air currents.

A still further object of the invention is to provide new and improved particle separating apparatus which is economical to manufacture and thoroughly reliable in operation.

In one illustrative embodiment of the invention, a stream of particles having different masses and magnetic characteristics is continuously fed into a rotary receptacle. The receptacle is rotated at a speed sufficient to centrifugally project the particles therefrom and form an umbrella-like array. The particles are projected over different distances proportional to their masses and are collected in separate cylindrical receiving bins concentric with the receptacle's axis of rotation. The size gradation within each bin is such that the particles may be readily employed in the manufacture of glass spheres or other industrial processes.

In accordance with one feature of the invention, in certain particularly important embodiments, the receptacle includes an upstanding side wall which defines a series of apertures having radially disposed axes. The size of the apertures is closely related to that of the individual particles with the result that any agglomerations of particles are broken up and each individual particle is projected separately from its aperture.

In accordance with another feature of several good embodiments of the invention, the projected particles are subjected to a magnetic field which is of sufficient strength to separate the particles having magnetic characteristics from the remaining particles. The separated particles are attracted by the magnetic field onto a continuously moving nonmagnetic conveyor which withdraws them from the vicinity of the receptacle.

In accordance with a further feature of the invention, in some embodiments, an evacuated enclosure is disposed around the rotary receptacle, the projected particles and the collecting bins to maintain these components under sub-atmospheric pressure. With this arrangement the deleterious effects of drafts, air currents, etc. on the separating process are substantially eliminated.

The present invention, as well as further objects and features thereof, will be more fully understood from the following description of certain preferred embodiments, when read with reference to the accompanying drawings.

BRIEF DESCRIPTION OF THE DRAWINGS

FIG. 3 is a partially schematic sectional view similar to FIG. 2 but illustrating particle separating apparatus for performing the successive steps of a separating method in accordance with another illustrative embodiment of the invention.

FIG. 4 is an enlarged fragmentary sectional view taken along the line 4—4 in FIG. 3.

DESCRIPTION OF CERTAIN PREFERRED EMBODIMENTS

Figure 1:
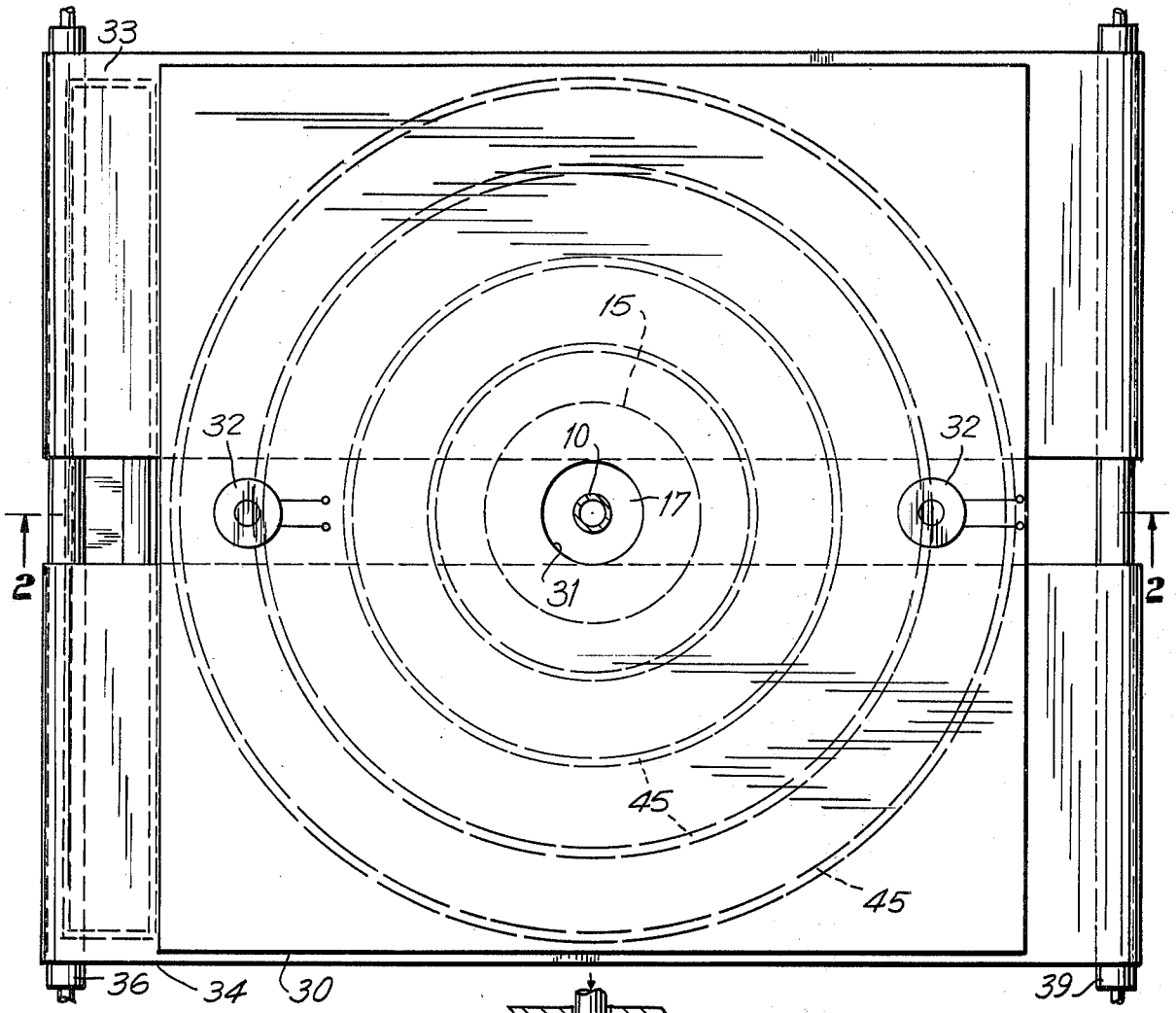
FIG. 1 is a partially schematic plan view of particle separating apparatus for performing the successive steps of a separating method in accordance with one illustrative embodiment of the invention.
Figure 2:
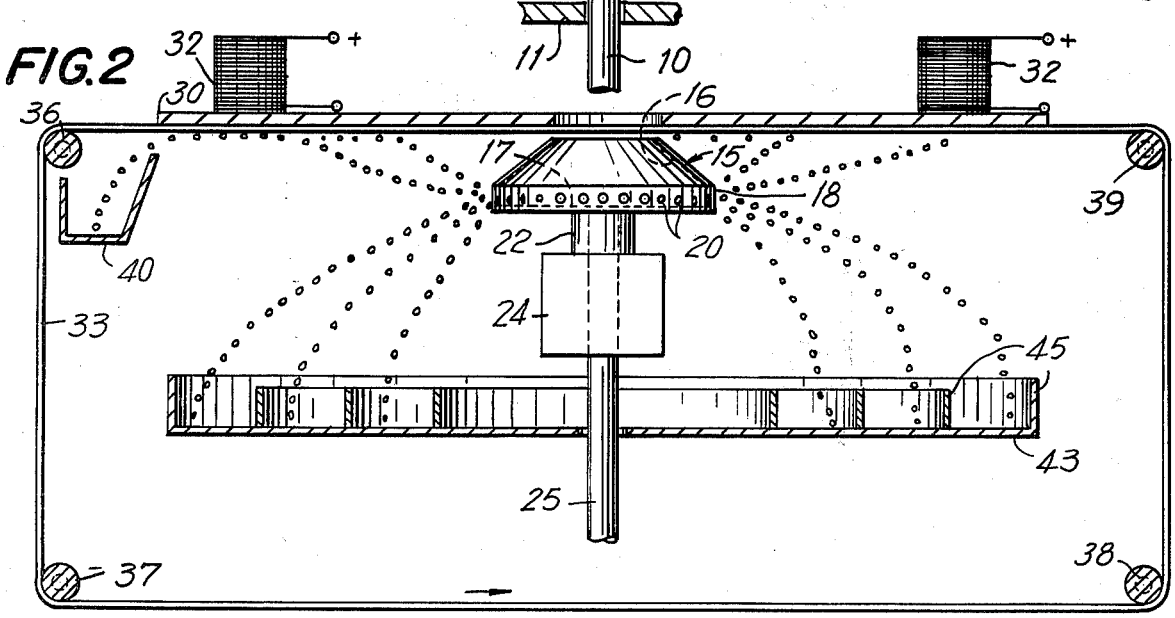
FIG. 2 is a partially schematic sectional view taken along the line 2—2 in FIG. 1, with certain parts shown broken away and in elevation.

Referring to FIGS. 1 and 2 of the drawings, there is shown separating apparatus which includes a vertically disposed infeed conduit 10. The conduit 10 is mounted on a support indicated schematically at 11 in position to receive a continuous stream of particles to be separated. These particles typically are in the form of crushed siliceous slag which contains substantial quantities of ferrous material. The density of the slag illustratively is of the order of about 2.5, while the ferrous material is substantially heavier and exhibits a density of about 7.5. The mass of the individual particles varies widely, and they range in size from approximately 80 mesh U.S. Standard to approximately 325 mesh U.S. Standard.

The infeed conduit 10 directs a free-flowing stream of the particles into an open-top rotary receptacle 15. The receptacle 15 is located in close juxtaposition beneath the discharge end of the conduit 10 and is of generally frusto-conical configuration. The receptacle is in the form of a substantially enclosed housing of hardened steel or other abrasion resistant material.

The receptacle 15 defines a centrally located cavity 16 which is formed by an inner material-receiving surface 17 and an upstanding cylindrical side wall 18. The surface 17 extends horizontally in a plane perpendicular to the axis of the infeed conduit 10 and is arranged a short distance beneath the lower end of the conduit in close proximity therewith. The side wall 18 is disposed around the periphery of the surface 17 and is coaxial with the conduit.

The side wall 18 includes a series of apertures 20 having radially disposed axes which all extend in a single horizontal plane. The apertures 20 are equally spaced around the rotational axis of the receptacle 15 and are of circular cross-section with a length which is substantially greater than their diameter. In the embodiment illustrated in FIGS. 1 and 2 the receptacle is provided with thirty such apertures which each have a diameter of one millimeter and a length of one and one half centimeters. For best results the diameter of each aperture is slightly less than twice the maximum dimension of the crushed particles within the receptacle.

A sleeve 22 serves to rotatably support the receptacle 15 in spaced relationship with the discharge end of the conduit 10. The receptacle 15 is rotated at a constant but adjustable speed by means of a variable speed drive mechanism shown schematically at 24. The mechanism 24 includes a suitable drive motor (not visible in FIGS. 1 and 2) which is connected to the receptacle 15 in a conventional manner through appropriate gearing. The receptacle 15, the sleeve 22 and the mechanism 24 are supported adjacent the upper end of an upstanding standard 25.

Interposed between the receptacle 15 and the infeed conduit 10 is a substantially square horizontal plate 30 of soft iron. This plate is provided with a centrally located circular opening 31 between the conduit 10 and the receptacle 15 to permit the free flow of the incoming particles to the receptacle. The plate supports a plurality of electromagnets 32, here being two in number, which are supplied with direct current to magnetize the plate to a single uniform polarity. In the illustrative embodiment of FIGS. 1 and 2 the plate 30 is magnetized to a "South" polarity to form a unidirectional magnetic field beneath the entire lower surface of the plate. The strength of the magnetic field is such that it extends beneath the level of the material receiving surface 17 of the receptacle 15 with its lowermost zone of influence at about the level of the upper part of the drive mechanism 24.

Two conveyor belts 33 and 34 are arranged along a rectangular path, as viewed in FIG. 2, with their upper portions in facing contact with the lower surface of the magnetic plate 30. The belts 33 and 34 are spaced apart by a distance equal to the diameter of the plate opening 31 and are each fabricated from polyethylene or other suitable nonmagnetic material.

The rectangular path of the conveyor belts 33 and 34 is defined by a drive roller 36 and three idler rollers 37, 38 and 39 at the four corners of the rectangle. The roller 36 serves to continuously drive the belts in a counterclockwise direction, as viewed in FIG. 2, at a constant speed.

A generally channel-shaped hopper 40 is disposed immediately adjacent the drive roller 36 beneath the upper portions of the belts 33 and 34. This hopper is in the form of a trough which is located parallel to but a short distance beyond the adjacent edge of the magnetic plate 30 in position to receive particles from the belts as they pass out of the influence of the magnetic field.

A comparatively large circular table 43 is horizontally positioned beneath the drive mechanism 24 in concentric relationship with the axis of rotation of the receptacle 18. In the embodiment of FIGS. 1 and 2 the table 43 is suitably supported, by means not shown, in a stationary position around the upstanding standard 25. In other advantageous arrangements, however, the table may be arranged to rotate in a manner more fully described in copending U.S. patent application Ser. No. 411,159 filed Oct. 30, 1973 by Ib von Irgens-Bergh.

A plurality of open-top cylindrical bins 45 are supported in spaced relationship with each other on the stationary table 43. The bins 45 are concentric with the rotational axis of the receptacle 15 and are located at progressively increasing distances from the axis in position to receive successive mass gradations of partices from the receptacle in separate bins.

The receptacle 15 is rotated by the drive mechanism 24 at a speed which is sufficient to centrifugally project the particles from the infeed conduit 10 through the apertures 20. The particular speed employed depends upon such factors as the densities of the material being separated, the desired degree of separation of the end product, and the rate of flow of the raw material from the conduit. The speed should be sufficiently high to fling the particles passing through the apertures 20 through a space and form a substantially flat sheet of particles. If the speed is too high, on the other hand, the centrifugal force applied to each particle may project the particle outside the influence of the magnetic field from the plate 30. For the more common siliceous slags ranging in size from about 80 mesh U.S. Standard to about 325 mesh U.S. Standard, the receptacle speed should be maintained within the range of approximately 1,000 revolutions per minute to approximately 5,000 revolutions per minute.

The centrifugal force imparted to the particles within the receptacle 15 causes the particles to acccelerate rapidly away from the receptacle's axis of rotation. As the particles strike the side wall 18 of the receptacle, any lumps or agglomerations are broken up, and the particles pass one by one through the cylindrical apertures 20 and are discharged into the surrounding space.

The particles moving through the apertures 20 continue to accelerate and are thrown outwardly in a single flat sheet or plane. The number of outwardly moving particles per unit area decreases in proportion to the square of the radius from the receptacle's axis of rotation. The particles are subjected to the influence of the magnetic field from the iron plate 30, and this field if effective to separate those particles which have magnetic characteristics from the remainder of the particles. The field magnetically attracts the magnetic particles out of the plane of particles and onto the continuously moving carrier belts 33 and 34.

The separated magnetic particles are held against the carrier belts 33 and 34 by the magnetic field from the plate 30. As the belts 33 and 34 move around their rectangular path, the magnetic particles continue in contact with the belts and are carried along to a discharge zone which is remotely located with respect to the receptacle. The particles move from right to left, as viewed in FIG. 2, and upon passing beyond the left hand edge of the plate 30 their attraction to the belts rapidly decreases. The particles drop off the belts and are collected by the hopper 40.

The remaining or nonmagnetic particles from the receptacle 15 continue their outward movement and form an umbrella-like pattern as a result of the influence of gravity. The remaining particles proceed from the receptacle over different distances which are proportional to their masses, with the larger and heavier particles traveling a greater distance than the smaller and lighter particles, and drop into the concentric bins 45 therebeneath.

With this arrangement, the concentric bins 45 receive successive mass gradations of the remaining particles in separate bits. Thus, the lighter, finer particles drop into the innermost bins, while the heavier, coarser particles are received in the outer bins. The gradation of the particles within each bin is such that they may be readily employed in the manufacture of glass spheres, for example, with surprisingly little size variation in the spheres in a production run from a given bin.

In the embodiment of FIGS. 1 and 2 the strength of the magnetic field is substantially uniform along the surface of the plate 30. In other advantageous arrangements the field strength may vary along the surface of the plate to provide even greater selectivity in the separating operation. This may be accomplished, for example, by employing a plate of varying magnetic permeability or by varying the intensity of the coils 32.

FIGS. 3 and 4 are illustrative of separating apparatus for performing a method in accordance with another preferred embodiment of the invention. This latter embodiment is particularly advantageous in providing successive mass gradations of crushed siliceous slag or other particles irrespective of their magnetic or nonmagnetic characteristics. The apparatus includes a pan-shaped feed hopper 50 of cylindrical configuration which is provided with a supply of the particles to be separated. The hopper 50 is disposed entirely within a cylindrical enclosure indicated at 52. This enclosure includes a bottom portion 53 and a removable cover portion 54 which is separated from the bottom portion by a circular plate 55. The plate 55 is sandwiched between suitable flanges on the portions 53 and 54, and the three components are held together by spaced bolts 56.

Axially located within the cylindrical enclosure 52 is a rotatable hollow shaft 60. The shaft 60 extends through a central opening in the circular plate 55 and is provided with a collar 61 which bears against the upper surface of the plate to maintain the lower end of the shaft spaced a short distance above the bottom of the feed hopper 50. The upper portion of the shaft is held in an upright position by an upstanding bracket 63 carried by the plate 55. This bracket is provided with two pillow blocks 65 and 66 which surround the shaft.

A rotary receptacle 67 is welded or otherwise rigidly affixed to the upper end of the hollow shaft 60. The receptacle 67 is generally similar to the receptacle 15 (FIG. 2) described heretofore and includes the cavity 16, the material receiving surface 17, the side wall 18 and the cylindrical apertures 20. Contrary to the receptacle 15, however, the surface 17 of the receptacle 67 is provided with an infeed opening 68 (FIG. 4). This opening is concentric with the shaft 60 and has a diameter which approximates the shaft's inside diameter.

An international helical conveyor 70 is integrally formed within the hollow shaft 60 for rotation therewith. The lower end of the conveyor 70 protrudes from the corresponding end of the shaft 60 and is exposed to the particles within the hopper 50, while the upper end of the conveyor communicates with the infeed opening 68 for the receptacle 67.

The hollow shaft 60 and the attached receptacle 67 rotate at a constant speed and are driven by a drive belt 72 and an electric motor 74. The motor 74 is positioned a short distance above the circular plate 55 and is supported by a bracket 75 carried by the pillow block 65. Power is supplied to the motor 74 through a cable 77 which extends through the side of the enclosure 52 and is connected to an externally located control panel 78. The panel 78 in turn is connected to a suitable electrical outlet by a power cable 80.

A circular table 82 is supported a short distance above the central plate 55. The table 82 is similar to the table 43 in the embodiment of FIGS. 1 and 2 and is provided with a series of concentric bins 83. These bins are arranged in coaxial relationship with the rotary receptacle 67 in position to receive successive size gradations of particles from the receptacle.

The cylindrical enclosure 52 surrounds and completely encloses the various components of the separating apparatus. The interior of the enclosure 52 is maintained at subatmospheric pressure by means of a vacuum pump shown schematically at 85. This pump is connected to the interior of the enclosure by a conduit 86 to maintain the feed hopper 50, the receptacle 67 and the bins 83 under reduced pressure which preferably is of the order of about one-half atmosphere.

Upon the energization of the drive motor 74, the belt 72 rotates the hollow shaft 60, the attached receptacle 67 and the screw conveyor 70 at a uniform constant speed. The conveyor 70 carries a continuous supply of particles from the feed hopper 50 through the opening 68 and into the cavity 16 within the receptacle. The particles entering the receptacle rapidly accelerate toward the side wall 18 and are contrifugally discharged through the apertures 20 into the interior of the enclosure 52 in a manner similar to that described heretofore.

The particles are projected outwardly from the receptacle 67 in a single flat sheet. The influence of gravity causes the projected particles to form an umbrella-like pattern, and the particles proceed over different distances from the receptacle's axis of rotation to their masses. The lightest particles fall into the innermost bin 83, and the successively heavier mass gradations of particles proceed into the successive outer bins. The arrangement is such that there is achieved an extremely precise separation of particles on the basis of their physical characteristics.

The rotational speed of the receptacle 67 should be sufficient to apply enough centrifugal force to each particle to break up any agglomerations of particles as they strike the side wall 18. For most applications the speed of the receptacle should be maintained in excess of about 1,000 revolutions per minute to insure the realization of optimum breaking-up action. The maximum speed of the receptacle is determined by the diameter of the outermost bin 83 and is adjusted such that the heaviest of the particles being separated do not pass beyond the periphery of this bin.

The particles being projected from the receptacle 67 are maintained at subatmospheric pressure by the pump 85. With this arrangement, and extremely smooth and even particle density is realized around the receptacle, and the path of the projected particles is independent of air currents, drafts, etc.

In some cases in which it is desired to separate magnetic particles from nonmagnetic particles through the use of the apparatus of FIGS. 3 and 4, the soft plate 30 (FIG. 2) and the electromagnetic coils 32 are positioned within the cylindrical enclosure 52 a short distance above the receptacle 67. One or more carrier belts similar to the belts 33 and 34 are arranged for movement around a closed path within the enclosure 52 such that portions of the belts pass along the lower surface of the plate 30. The belts serve to direct the magnetic particles into a suitable hopper in the manner described heretofore.

In order to more thoroughly disclose the nature of the present invention, the following examples illustrating the invention are given. It should be understood, however, that this is done solely by way of example and is intended neither to delineate the scope of the invention nor limit the ambit of the appended claims.

EXAMPLE 1

As an example of the effectiveness of the method and apparatus of the present invention in the separation of siliceous slag contaminated with iron powder, particles of the contaminated material were gravity fed into the center of an open-top rotary receptacle of the type illustrated in FIGS. 1 and 2. The material entered the receptacle in a free-flowing stream, and the receptacle was rotated at a uniform constant speed of 2,500 revolutions per minute. The external diameter of the receptacle was 17 centimeters, and the receptacle's side wall was provided with 30 apertures each having a diameter of one millimeter and a length of one and one-half centimeters. A circular table having a diameter of 250 centimeters was positioned in concentric relationship beneath the receptacle and was provided with four concentric bins in equidistant relationship with each other.

As the receptacle rotated the particles were centrifugally projected through the apertures in the side wall, and the particles closest to the receptacle were observed to lie in a single substantially horizontal plane. The outwardly moving particles then formed an umbrella-like pattern and proceeded over different distances into the bins. Upon the examination of the particles collected within the bins, substantially all of the particles within the innermost bin exhibited a size within the range of from 270 mesh U.S. Standard to 325 mesh U.S. Standard, the particles in the next innermost bin exhibited a size within the range of from 200 mesh U.S. Standard to 270 mesh U.S. Standard, the particles within the next bin exhibited a size within the range of from 140 mesh U.S. Standard to 200 mesh U.S. Standard and the particles within the outermost bin exhibited a size within the range of from 80 mesh U.S. Standard to 140 mesh U.S. Standard. These successive size gradations were observed to be extremely precise, with substantially no particles outside any of these ranges in the corresponding bins.

EXAMPLE 2

In cases in which the procedure of Example 1 is repeated with the particles under the influence of a magnetic field of the type provided by the soft iron plate 30 and the electromagnetic coils 32 of FIGS. 1 and 2, the projected particles having magnetic characteristics are withdrawn from the umbrella-like pattern and proceed onto a polyethylene carrier belt beneath the magnetic plate. As the belt removes the magnetic particles from the vicinity of the receptacle, they are deposited in a suitable hopper for further processing. The remaining, nonmagnetic particles drop by gravity into the successive bins with substantially the same size gradations described in the previous example.

EXAMPLE 3

The procedures of Examples 1 and 2 are repeated with varying rotational speeds for the receptacle. Below about 1,000 revolutions per minute, the centrifugal force applied to the particles is insufficient to discharge all of the particles from the receptacle, with the result that the separation operation is incomplete. When the speed is increased to above about 5,000 revolutions per minute, some of the heavier particles are projected beyond the outermost bin and are not effectively separated according to their mass or magnetic characteristics. Within the 1,000 to 5,000 revolution per minute range, however, the separation of the particles is satisfactory.

One advantage of the arrangement of FIGS. 1 and 2 over that of FIGS. 3 and 4 is that the process of FIGS. 1 and 2 may be carried out on a continuous basis. The FIGS. 3 and 4 process, on the other hand, is of the batch type, and after each run a fresh supply of material to be separated is inserted into the feed hopper 50. This is accomplished in a straightforward manner by removing the cover portion 54 and the circular plate 55 and inserting the additional material into the hopper through the use of a suitable infeed chute.

The siliceous particles in the concentric bins as well as the magnetically separated particles may be employed for a wide variety of commercial operations. As illustrations, the particles may be spheroidized and used as carriers for xerographic equipment, as fillers for plastic materials, or for various electrical applications. The spheroidized siliceous particles additionally may be employed for reflective purposes, such as in lane marking for highways, for road and advertising signs, motion picture screens, etc. These and many other uses for the separated particles will become apparent to those skilled in the art upon a perusal of the present disclosure.

The terms and expressions which have been employed are used as terms of descriptions and not of limitation, and there is no intention in the use of such terms and expressions of excluding any equivalents of the features shown and described, or portions thereof, it being recognized that various modifications are possible within the scope of the invention claimed.

What is claimed is:

1. A method for separating particles of different physical characteristics, comprising the steps of:

directing a supply of particles having different masses and magnetic characteristics into a rotary receptacle, the receptacle including an upstanding side wall which defines a series of apertures;

continuously rotating the receptacle at a speed sufficient to centrifugally project the particles through the apertures;

subjecting the projected particles to a magnetic field, the magnetic field drawing the particles having magnetic characteristics upwardly away from the remaining particles;

magnetically attracting the thus separated particles onto a continuously moving carrier to withdraw the separated particles from the vicinity of the receptacle;

the rotary receptacle projecting the remaining particles over different distances proportional to their masses; and collecting successive mass gradations of said remaining particles.

2. A method for separating particles of different physical characteristics, comprising the steps of:

directing a stream of particles having different masses and magnetic characteristics into a rotary receptacle mounted within an evacuated enclosure, the receptacle including an upstanding side wall which defines a series of cylindrical apertures;

continuously rotating the receptacle at a speed sufficient to centrifugally project the particles through the apertures;

subjecting the enclosure to subatmospheric pressure to eliminate air currents around the projected particles;

subjecting the projected particles to a magnetic field, the magnetic field drawing the particles having magnetic characteristics upwardly away from the remaining particles;

magnetically attracting the thus separated particles onto a continuously moving carrier to withdraw the separated particles from the vicinity of the receptacle;

the rotary receptacle projecting the remaining particles over different distances proportional to their masses; and collecting successive mass gradations of said remaining particles in separate receiving bins.

3. A method for separating particles of different physical characteristics, comprising the steps of:

directing a free-flowing stream of particles having different masses and magnetic characteristics into an open-top rotary receptacle, the receptacle including an upstanding side wall which defines a series of cylindrical apertures having radially disposed axes extending in a single plane;

continuously rotating the receptacle at a speed within the range of from about 1,000 revolutions per minute to about 5,000 revolutions per minute to centrifugally project the particles through the apertures;

subjecting the projected particles to a magnetic field, the magnetic field drawing the particles having magnetic characteristics upwardly away from the remaining particles;

magnetically attracting the thus separated particles onto continuously moving carrier belts above said receptacle to withdraw the separated particles from the vicinity of the receptacle;

the rotary receptacle projecting the remaining particles over different distances proportional to their masses; and collecting successive mass gradations of said remaining particles in separate cylindrical receiving bins concentric with the receptacle's axis of rotation.

4. Apparatus for separating particles of different physical characteristics, the apparatus comprising, in combination:

infeed means for providing a supply of particles having different masses and magnetic characteristics;

a rotary receptacle for receiving the particles from the infeed means, the receptacle including an upstanding side wall which defines a series of apertures, each of said apertures being of cylindrical configuration and having a diameter which is less than twice the maximum dimension of the particles within the receptacle;

means for continuously rotating the receptacle at a speed sufficient to centrifugally project the particles through the apertures;

field generating means mounted above said projected particles for forming a unidirectional magnetic field in close juxtaposition with the projected particles, the magnetic field drawing the particles having magnetic characteristics upwardly away from the remaining particles, the rotary receptacle projecting said remaining particles over different distances proportional to their masses; and collecting means for receiving successive mass gradations of said remaining particles.

5. Apparatus for separating particles of different physical characteristics, the apparatus comprising, in combination:

infeed means for providing a continuous stream of particles having different masses and magnetic characteristics;

a rotary receptacle for receiving the stream of particles from the infeed means, the receptacle including an upstanding side wall which defines a series of apertures;

means for continuously rotating the receptacle at a speed sufficient to contrifugally project the particles through the apertures;

field generating means mounted above said projected particles for forming a unidirectional magnetic field in close juxtaposition with the projected particles, the magnetic field drawing the particles having magnetic characteristics upwardly away from the remaining particles, the rotary receptacle projecting said remaining particles over different distances proportional to their masses;

a continuously moving conveyor interposed above the receptacle between the projected particles and the field generating means for collecting the separated magnetic particles and withdrawing the same from the vicinity of the receptacle; and collecting means for receiving successive mass gradations of said remaining particles.

6. Apparatus for separating particles of different physical characteristics, the apparatus comprising, in combination:

infeed means for providing a continuous stream of particles having different masses and magnetic characteristics;

an open-top rotary receptacle for receiving the stream of particles from the infeed means, the receptacle including an upstanding cylindrical side wall which defines a series of cylindrical apertures having radially disposed axes extending in a single plane;

means for continuously rotating the receptacle at a speed sufficient to centrifugally project the particles through the apertures;

field generating means mounted above said projected particles for forming a unidirectional magnetic field in close juxtaposition with the projected particles, the magnetic field drawing the particles having magnetic characteristics upwardly away from the remaining particles, the rotary receptacle projecting said remaining particles over different distances proportional to their masses;

a continuously moving conveyor interposed above the receptacle between the projected particles and the field generating means for collecting the separated magnetic particles and withdrawing the same from the vicinity of the receptacle; and collecting means including a plurality of cylindrical bins concentric with the receptacle's axis of rotation for receiving successive mass gradations of said remaining particles in separate ones of said bins.

7. Apparatus for separating particles of different physical characteristics, the apparatus comprising, in combination:

infeed means for providing a continuous supply of particles having different masses and magnetic characteristics;

a rotary receptacle for receiving the particles from the infeed means, the receptacle including an upstanding side wall which defines a series of cylindrical apertures;

means for rotating the receptacle at a speed in excess of about 1,000 revolutions per minute to centrifugally project the particles through the apertures;

field generating means mounted above said projected particles for forming a unidirectional magnetic field in close juxtaposition with the projected particles, the magnetic field drawing the particles having magnetic characteristics upwardly away from the remaining particles, the rotary receptacle projecting said remaining particles over different distances proportional to their masses;

a continuously moving conveyor interposed above the receptacle between the projected particles and the field generating means for collecting the separated magnetic particles and withdrawing the same from the vicinity of the receptacle;

collecting means including a plurality of cylindrical bins concentric with the receptacle's axis of rotation for receiving successive mass gradations of said remaining particles in separate ones of said bins; and evacuated enclosure means surrounding the rotary receptacle, the projected particles and the collecting means for maintaining the same under subatmospheric pressure to eliminate air currents around the projected particles.

* * * * *